US006851640B2

(12) United States Patent
Massaro

(10) Patent No.: US 6,851,640 B2
(45) Date of Patent: Feb. 8, 2005

(54) EASILY TRANSPORTABLE HOSE REEL

(76) Inventor: John S. Massaro, 18 Dogwood La., South, Pomona, NY (US) 10970

( * ) Notice: Subject to any disclaimer, the term of this patent is extended or adjusted under 35 U.S.C. 154(b) by 38 days.

(21) Appl. No.: 10/244,781

(22) Filed: Sep. 16, 2002

(65) Prior Publication Data

US 2003/0015618 A1 Jan. 23, 2003

Related U.S. Application Data

(63) Continuation-in-part of application No. 09/537,890, filed on Mar. 29, 2000, now abandoned.

(51) Int. Cl.[7] ..... B65H 75/44
(52) U.S. Cl. ..... 242/399; 242/403.1; 137/355.27
(58) Field of Search ..... 242/399, 399.2, 242/403, 403.1, 557, 533.8, 598.5; 137/355.26, 355.27

(56) References Cited

U.S. PATENT DOCUMENTS

| | | | | |
|---|---|---|---|---|
| 183,188 A | | 10/1876 | McGaffey | |
| 289,960 A | | 12/1883 | Billings | |
| 779,612 A | | 1/1905 | Larson | |
| 828,562 A | * | 8/1906 | Melven | 242/403.1 |
| 1,350,205 A | * | 8/1920 | Anderson | 137/355.27 |
| 1,850,677 A | | 3/1932 | Kieneman | |
| 2,306,989 A | | 12/1942 | Cordingley | |
| 2,540,434 A | | 2/1951 | Fengler | |
| 3,134,555 A | * | 5/1964 | Baker | 242/594.3 |
| 3,366,344 A | * | 1/1968 | Smith et al. | 242/390 |
| 4,137,939 A | * | 2/1979 | Chow | 137/355.27 |
| 4,227,661 A | | 10/1980 | King et al. | |
| 5,113,546 A | * | 5/1992 | Parent | 15/315 |
| 5,236,131 A | | 8/1993 | Hayward | |
| 5,462,298 A | * | 10/1995 | Bodine | 280/47.34 |
| 5,560,391 A | * | 10/1996 | Bantaculo | 137/355.23 |
| 6,199,786 B1 | * | 3/2001 | Lessard et al. | 242/406 |

OTHER PUBLICATIONS

Northern Tool & Equipment Co., 1999 Fall/Winter Master Catalog, p. 110, 111.
McMaster–Carr Supply Company, Catalog 81, 1975, p. 887.
Modern Farm Mercantile, Country Lifestyle Products–Christmas 1999, p. 20.

* cited by examiner

*Primary Examiner*—John Q. Nguyen
(74) *Attorney, Agent, or Firm*—Muserlian, Lucas and Mercanti

(57) ABSTRACT

The hose reel suitably has a hub mounted on a frame to accept an air hose, said hub being rotatable to wind the air hose. Wheels are attached to one end of the frame and at least one leg is affixed to the back of the frame. The leg enables the frame to be stable when it is rotated 90° off the wheels and onto the leg.

29 Claims, 4 Drawing Sheets

EASILY TRANSPORTABLE HOSE REEL

PRIOR APPLICATION

This is a continuation-in-part of application Ser. No. 09/537,890 filed Mar. 29, 2000, abandoned.

BACKGROUND OF THE INVENTION

The present invention relates to a hose reel, particularly for an air hose, which is easily transportable. Reels for air hoses are typically permanently mounted, either on a vehicle or on a stationary apparatus; however, there are many instances where portability of the hose is desirable. In such situations, a loose hose is simply dragged to the site of operation. There are, of course, inherent disadvantages to carrying a hose which is not mounted on a reel, notably: the hose is heavy to transport; it frequently becomes kinked when pulled out; and it is difficult to rewind.

Portable hose reels are known but are difficult to use since the reels are generally heavy and difficult to move. Additionally, hose reels which have wheels so that they can be rolled are unstable and thus similarly difficult to use.

SUMMARY OF THE INVENTION

The present invention avoids the difficulty of carrying a loose hose and overcomes the limitations of the heavy and unwieldy hose reels which are known in the art. This is accomplished by having a hose reel which is portable and which uses wheels affixed to one end of the hose reel. When the user desires to unwind the hose, the entire hose reel can be rotated 90° so that the wheels are no longer in engagement with the ground. It has been found that this structure provides great mobility when transporting the hose and also produces great stability when deploying the hose.

BRIEF DESCRIPTION OF THE DRAWINGS

These and other features of the present invention may be more fully understood with reference to the accompanying drawings wherein.

DETAILED DESCRIPTION OF THE DRAWINGS

Figure 1:
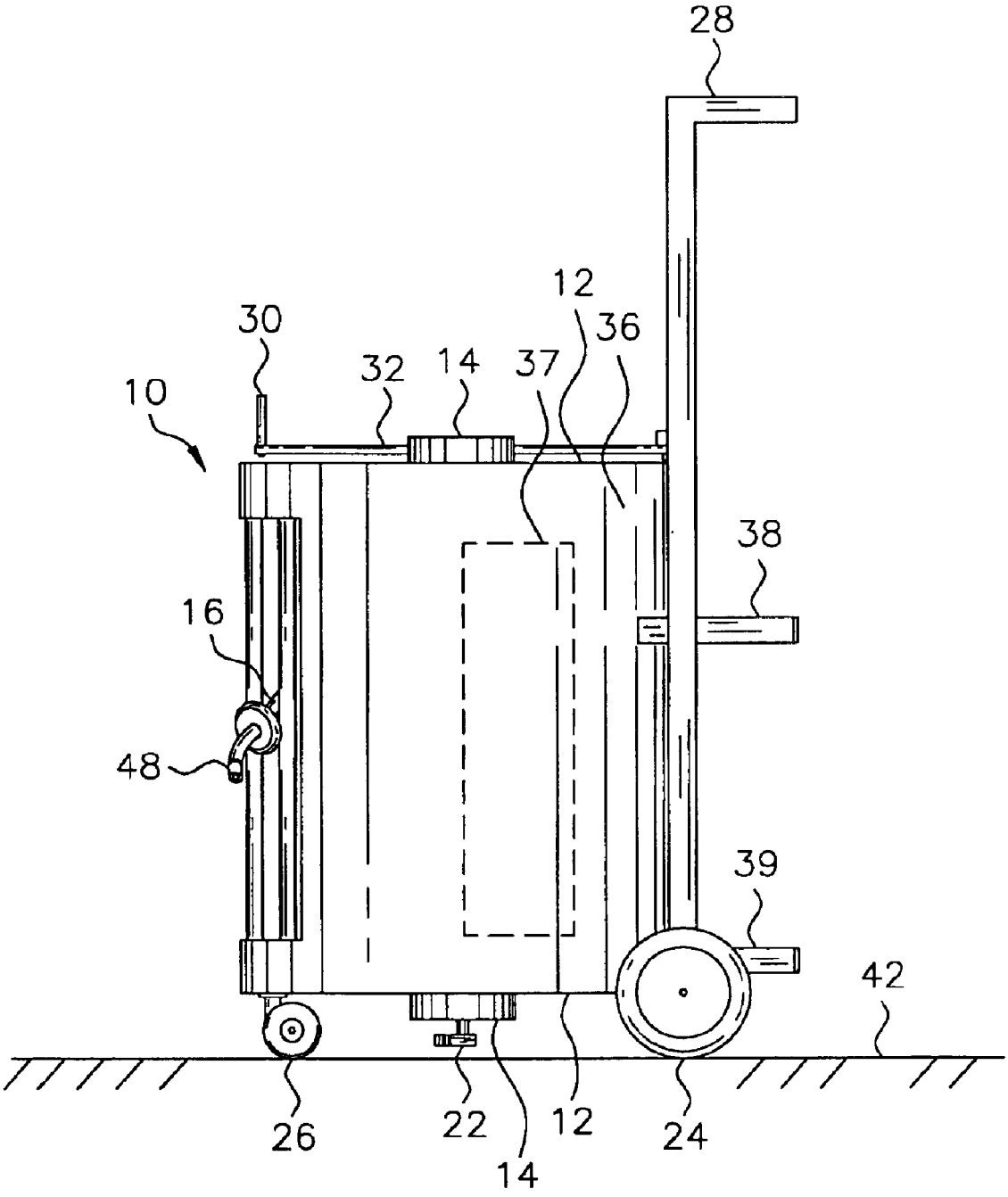
FIG. 1 shows one preferred embodiment of the hose reel of the present invention from a side view.
Figure 2:
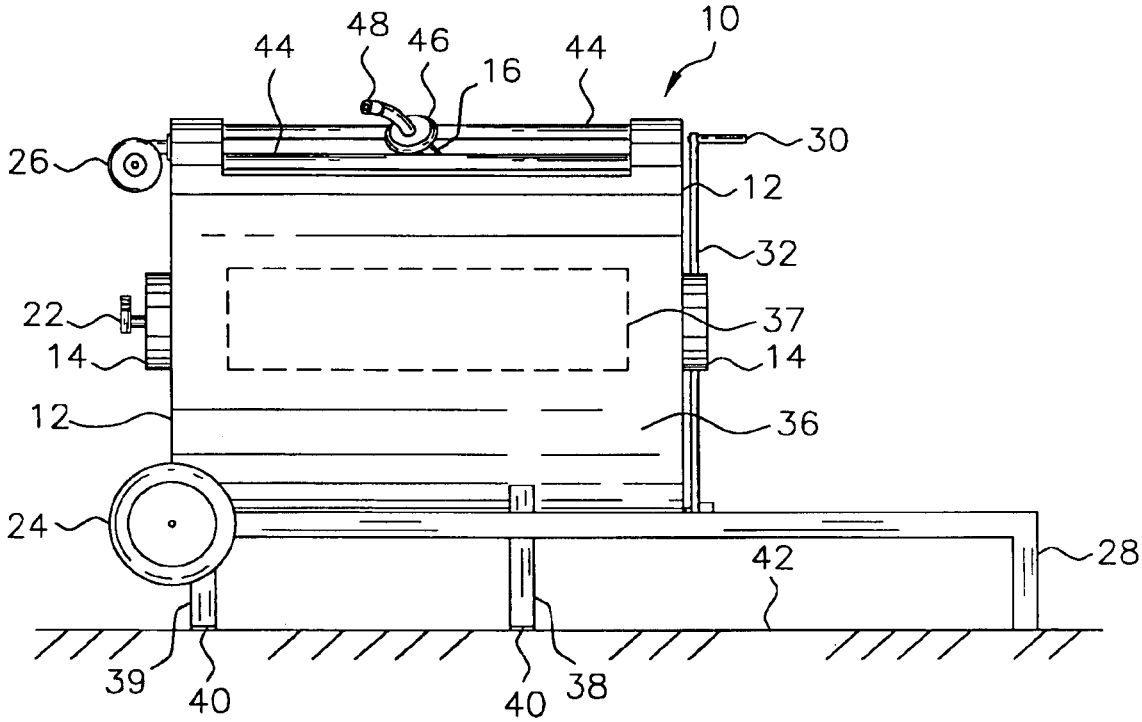
FIG. 2 shows the hose reel of FIG. 1 rotated 90° to its operative position.
Figure 3:
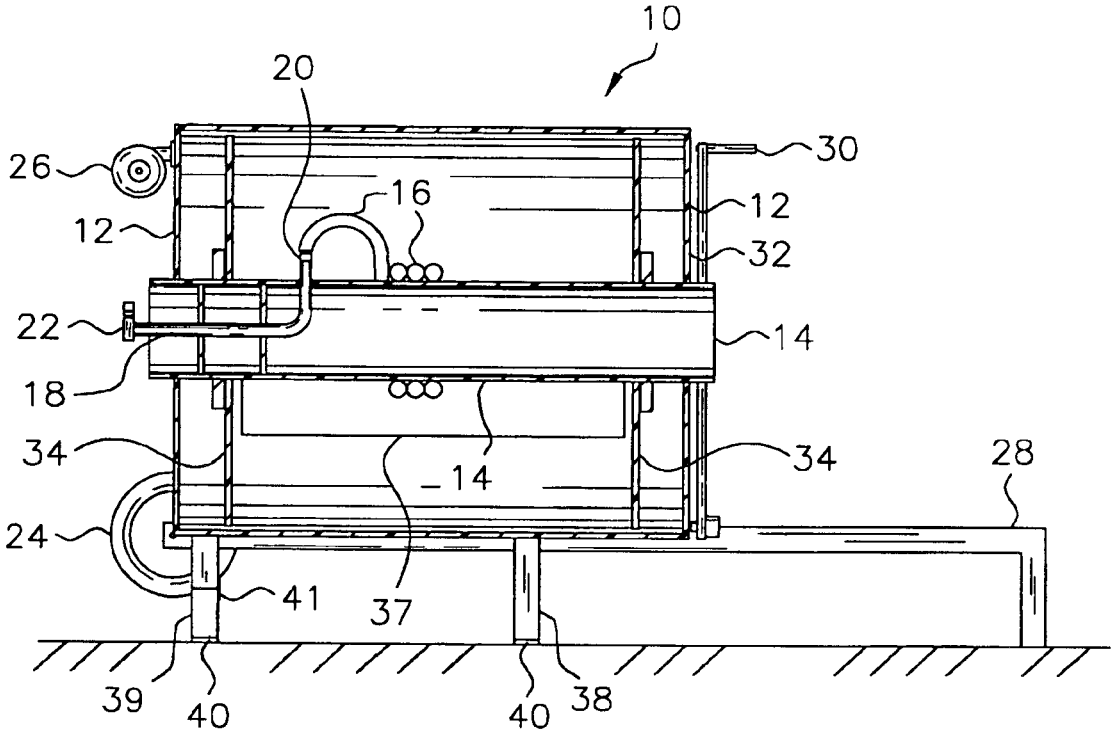
FIG. 3 shows a cross-sectional view of the hose reel of FIG. 2.

Referring to FIGS. 1–3, there is shown a hose reel 10 comprising ends 12 and a hub 14. Air hose 16 is wound about the hub 14 (see FIG. 3) in standard fashion. The hub 14 is suitably about 3 to about 6 inches in diameter, and is most preferably about 4 inches in diameter. The hub includes a supply pipe 18 which is L-shaped and extends through hub 14 for attachment to hose 16 at pipe end 20. The other end of supply pipe 18 is suitably connected to a swivel 22. Air from a compressor (not shown) is supplied to the swivel 22 through a supply hose (not shown) and then through hub 14 to pipe end 20 for connection to hose 16.

Wheels are affixed to one of the ends 12 of the hose reel 10. As shown, and as preferred, the wheels comprise large fixed wheels 24 and small swivel wheels 26. It will be appreciated, however, that all of the wheels can be of the same size and can swivel or not, as desired. It will further be appreciated that other types of transport means, such as plastic discs sold under the trademark E-Z Glider, can be employed instead of some or all of the wheels.

A cart handle 28 is also preferably provided for ease of movement of the hose reel. A reel handle 30 is connected to hub 14 by reel arm 32. The reel handle 30 enables the hub 14 to be rotated for winding the hose on the hub 14. The hub 14 is suitably mounted in holes of discs 34 (FIG. 3) and is free to rotate within them. The discs 34 are preferably made of about ¼-inch thick polyethylene and are preferably about 14 to about 18 inches in diameter.

As will be appreciated, when hub 14 is in the transport position (FIG. 1), it will be substantially vertical with respect to the ground. In order to prevent any hose wound on hub 14 from falling loose, the reel is preferably provided with an exterior drum 36. The drum preferably surrounds at least about 80% of the hose reel 10. The drum preferably also includes an access door 37 for replacing the hose or for freeing it if it happens to become snagged.

Referring now specifically to FIG. 2, there is shown the hose reel of the present invention rotated 90° so that the hose is readily accessible. Wheels 24 and 26 are completely off the ground and the reel 10 is supported by legs 38, 39 attached to the drum 36. It will be appreciated that the legs 38, 39 can be integral with the ends 12 if desired. It will also be understood that cart handle 28 can be substituted for leg 38 if desired. The legs 38, 39 are preferably provided with non-slip strips 40, suitably of rubber or a similar non-slip material. Non-slip buttons (not shown) may be employed in place of non-slip strips 40, if desired.

In the operative position of FIG. 2, the hub 14 is substantially horizontal with respect to the floor 42 so that the hose 16 can be easily wound and unwound. The hose 16 is preferably guided through free-wheeling rollers 44, which aid in both unwinding and rewinding the hose. A hose stop 46, such as a rubber ball with a hole to allow the hose to pass therethrough in tight-fitting engagement, is preferably provided so that the end 48 of hose 16 does not go into the drum 36.

The legs 38, 39 are required so that the hose 16 can be pulled out and subsequently reeled in using reel handle 30. The cart handle 28 and the large wheels 24 allow the reel 10 to be easily rotated to its working position wherein the hub 14 is horizontal to the ground.

When it is desired to transport the hose reel of the present invention up or down a set of stairs, leg 39 may cause interference. This can be readily overcome by making leg 39 in two pieces as shown in FIG. 3, with the two pieces being joined by a hinge 41. The lower part of leg 39 can then be rotated 180° so that it does not interfere with movement up or down stairs. Retaining means (not shown) can be used to maintain leg 39 in either the extended or folded position. Alternatively, leg 39 can be positioned farther away from wheel 24 so that is does not interfere with movement up and down stairs.

Figure 4:
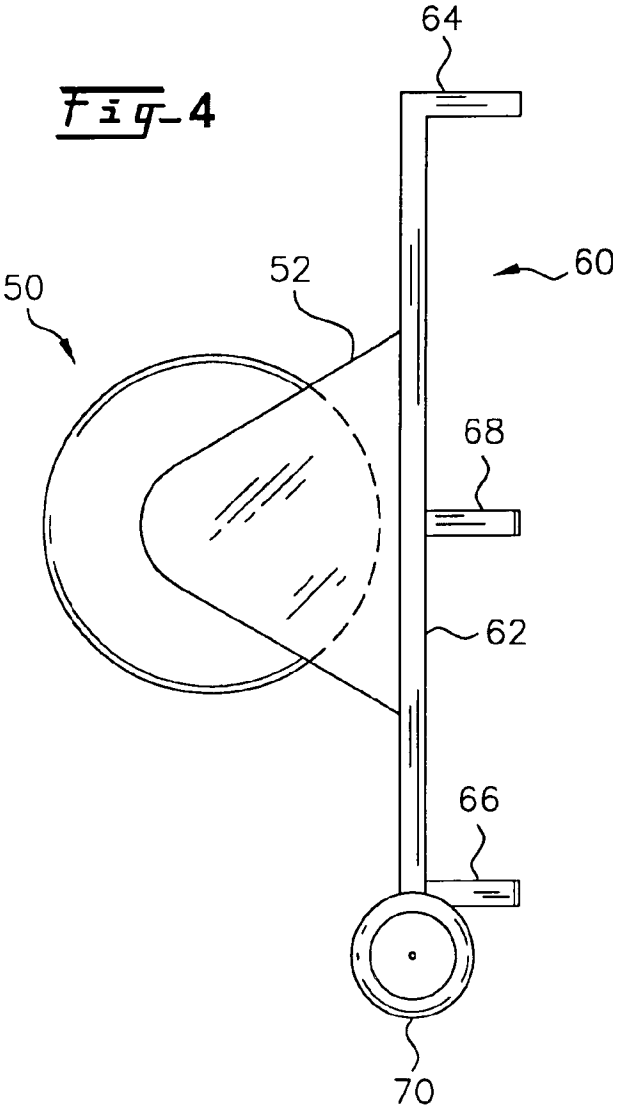
FIG. 4 shows a side view of an alternate preferred embodiment of the hose reel of the present invention.

Turning now to FIG. 4, there is shown an alternate preferred embodiment of the present invention. In this embodiment a steel reel 50 mounted in a steel frame 52 is attached to a carrying member 60. The reel 50 may be mounted either parallel or perpendicular to (as shown in FIGS. 1–3) frame 52. The carrying member comprises a main member 62 to which are attached a pull handle 64 and a leg 66. An additional leg 68 may be added, if desired.

Figure 5:
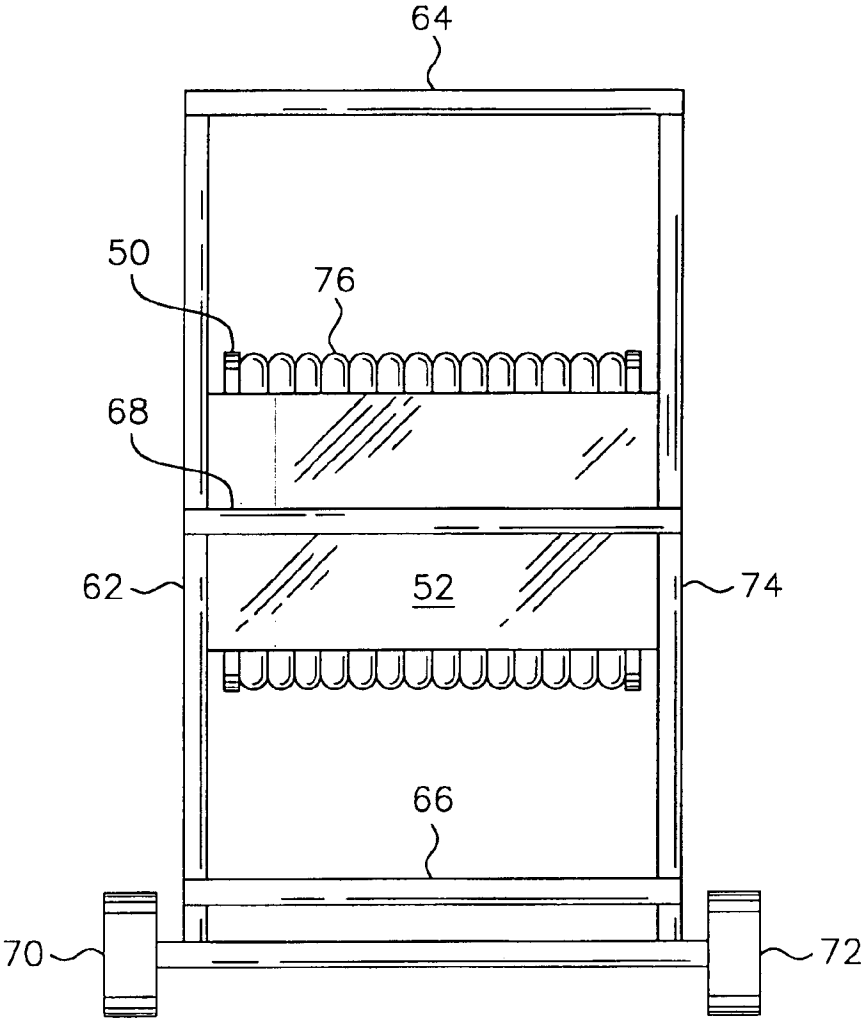
FIG. 5 shows a bottom view of the embodiment of FIG. 4.

Affixed to the bottom of the main member 62 is a wheel 70. As shown in FIG. 5, there is a second wheel 72 attached to main member 74 which corresponds to main member 62. FIG. 5 also shows a hose 76 mounted on the hose reel 50.

Returning to FIG. 4, and as with the embodiment described in FIGS. 1–3, when the carrying member is rotated from the vertical to the horizontal position the wheels are no longer in engagement with the ground because of leg 66. This provides stability when deploying the hose. Leg 66 is located proximate to the wheels 70 and 72. As used herein, the word "proximate" means that the leg is effective to lift wheels 70 and 72 off the ground and provide stability. The leg could be a foot or more away from the wheels and still be "proximate" within the meaning of the present invention.

Many of the features of the embodiment of FIGS. 1–3 can also be used in the embodiment of FIGS. 4–5, e.g. a drum 36 and its related components. Similarly, there could be two sets of wheels as in FIGS. 1–3. In this embodiment a flat plate (not shown) could be attached to frame 52 near wheels 70, 72 and perpendicular to the frame, and caster-type wheels could be attached to the plate as in FIGS. 1–3. The additional wheels allow the hose reel to be easily transported when frame 52 is in the vertical position.

While the present invention has been described with respect to use as an air hose reel, which is the preferred embodiment, it will be appreciated that the device of the present invention can also be advantageously used with other windable materials. As used herein, the term "windable material" means anything which can be wound on a hub. This may include, for example, power washing hoses, water hoses, hydraulic hoses, and vacuum hoses. Furthermore, the device of the present invention may be used with other types of windable materials, such as extension cords, ropes, wires, cables and the like.

It will be understood that the claims are intended to cover all changes and modifications of the preferred embodiments of the invention herein chosen for the purpose of illustration which do not constitute a departure from the spirit and scope of the invention.

What is claimed is:

1. A hose reel for an air hose having a specified diameter, said hose reel comprising:

(a) a drum having an opening at least large enough to accept the specified diameter of said air hose therethrough;

(b) said drum having opposed ends;

(c) two, straight, elongated, main members affixed to said drum, that extend along each side of said drum from one of said ends of said drum to past the other of said ends of said drum;

(d) a hub in said drum positioned at substantially the center thereof and being rotatable with respect to said drum;

(e) means for rotating said hub;

(f) wheels attached to one end of said main members adjacent said one of said ends of said drum, said wheels enabling the drum to be transported across a surface where said drum is normally intended to be used when said drum is rotated so that the hub is in a substantially vertical position; and (g) a first leg affixed to said two main members proximately at said one of said ends of said drum and extending perpendicularly away from said main members and said drum;

(h) a second leg affixed to said two main members proximately at the other of said ends of said drum, said second leg extending perpendiculary away from said main members and said drum;

(i) a handle affixed to said two main members at an end of said members opposite said first leg; and (j) said first and second legs providing that when the drum is rotated to a position where said hub is in substantially horizontal position said first and second legs support said reel so that there are no wheels in contact with the surface.

2. The hose reel of claim 1 wherein said hub is about 3 to about 6 inches in diameter.

3. The hose reel of claim 1 wherein said hub is about 4 inches in diameter.

4. The hose reel of claim 1 wherein said hub includes a supply pipe having ends which extend through said hub for attachment to a hose at one end.

5. The hose reel of claim 4 wherein a swivel is attached to said supply pipe at the other end.

6. The hose reel of claim 1 wherein said opening includes freewheeling rollers.

7. The hose reel of claim 1 wherein said first and second legs are provided with a material to deter slippage.

8. The hose reel of claim 1 further comprising discs located toward said opposed ends and wherein said hub is mounted in holes in said discs.

9. The hose reel of claim 8 wherein said discs are of about ¼-inch thick polyethylene.

10. The hose reel of claim 8 wherein said discs are about 14 to about 18 inches in diameter.

11. The hose reel of claim 1 wherein said drum surrounds at least about 80% of the hose reel.

12. The hose reel of claim 1 wherein said drum includes an access door.

13. A reel for a windable material, said reel comprising:

(a) a drum having an opening at least large enough to accept the windable material therethrough;

(b) said drum having opposed ends;

(c) two, straight, elongated, main members affixed to said drum, that extend along each side of said drum from one of said ends of said drum to past the other of said ends of said drum;

(d) a hub in said drum positioned at substantially the center thereof and being rotatable with respect to said drum;

(e) means for rotating said hub;

(f) wheels attached to one end of said main members at said one of said ends of said drum, said wheels enabling the drum to be transported across a surface where said drum is normally intended to be used when said drum is rotated so that the hub is in a substantially vertical position; and (g) a handle affixed to said two main members at an end of said members opposite said wheels; and (h) two legs one of said two legs affixed to said main members proximately at said one of said ends of said drum, the other of said two legs affixed to said main members proximately at the other of said ends of said drum, said two legs extending perpendicularly away from said main members and said drum, enabling the drum to be stable, and said two legs being structured such that when the drum is rotated to a position where said hub is in a substantially horizontal position said legs support said reel so that there are no wheels in contact with the surface.

14. The reel of claim 13 wherein said opening includes freewheeling rollers.

15. The reel of claim 13 wherein the legs are provided with a material to deter slippage.

16. The reel of claim 13 wherein said drum includes an access door.

17. The reel of claim 13 wherein said drum surrounds at least about 80% of the reel.

18. The reel of claim 13 wherein said hub is about 3 to about 6 inches in diameter.

19. The reel of claim 13 wherein said hub is about 4 inches in diameter.

20. The reel of claim 13 wherein said hub includes a supply pipe having ends which extend through said hub for attachment to a windable material at one end.

21. The reel of claim 20 wherein a swivel is attached to said supply pipe at the other end.

22. The reel of claim 13 wherein the wheels comprises plastic discs.

23. The reel of claim 13 further comprising discs toward said opposed ends and wherein said hub is mounted in holes in said discs.

24. The reel of claim 23 wherein said discs are of about ¼-inch thick polyethylene.

25. The reel of claim 23 wherein said discs are about 14 to about 18 inches in diameter.

26. A hose reel for transport and a use on a surface comprising:

(a) a carrying member having a front and back, two sides and a top and a bottom, said carrying member comprising two straight elongated main members that form the two sides of said carrying member;

(b) a reel mounted in a frame;

(c) said frame being attached to said carrying member on the front thereof;

(d) wheels attached to the bottom of said carrying member at the two sides thereof;

(e) a first leg mounted on the back of said carrying member proximately at the wheels, said first leg affixed to each of said main members and extending perpendicularly away from said main members;

(f) a second leg mounted on said carrying member on the back of said carrying member proximately at an end of said frame opposite said wheels, said second leg affixed to each of said main members and extending perpendicularly away from said main members;

(g) said wheels allowing said hose reel to be transported across the surface when the carrying member is in a substantially vertical position;

(h) a handle affixed to said carrying member and positioned on the top of said carrying member;

(i) rotation of the carrying member from the substantially vertical position to the substantially horizontal position causing the first and second legs to engage the surface and causing the wheels to be lifted clear of the surface.

27. The hose reel of claim 26 wherein said first and second legs are provided with a material to deter slippage.

28. The hose reel of claim 26 wherein said reel is mounted horizontally with respect to said frame.

29. The hose reel of claim 26 wherein said reel is mounted transversely with respect to said frame.

* * * * *